US009561901B2

(12) United States Patent
Dogan et al.

(10) Patent No.: US 9,561,901 B2
(45) Date of Patent: Feb. 7, 2017

(54) CAPSULE HAVING A PIERCEABLE PLUG TO PREVENT BACKFLOW

(71) Applicant: NESTEC S.A., Vevey (CH)

(72) Inventors: Nihan Dogan, La Croix-sur-Lutry (CH); Nicolas Jean-Guy Bezet, Macon (FR); Ahmed Azouz, Prilly (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/399,661

(22) PCT Filed: May 1, 2013

(86) PCT No.: PCT/EP2013/059063
§ 371 (c)(1),
(2) Date: Nov. 7, 2014

(87) PCT Pub. No.: WO2013/167434
PCT Pub. Date: Nov. 14, 2013

(65) Prior Publication Data

US 2015/0140182 A1 May 21, 2015

(30) Foreign Application Priority Data

May 7, 2012 (EP) ..... 12166963

(51) Int. Cl.
*B65D 85/804* (2006.01)

(52) U.S. Cl.
CPC ..... *B65D 85/8043* (2013.01)

(58) Field of Classification Search
CPC ..... B65D 85/8043; B65D 85/804
USPC ..... 426/77, 78, 79, 80, 81, 82, 83, 84
See application file for complete search history.

(56) References Cited

U.S. PATENT DOCUMENTS

2002/0078831 A1* 6/2002 Cai ..... 99/295
2002/0131902 A1* 9/2002 Levy ..... B01L 3/50825 422/570
2006/0231519 A1* 10/2006 Py ..... B65D 51/002 215/342
2010/0239734 A1* 9/2010 Yoakim ..... A47J 31/22 426/433

(Continued)

FOREIGN PATENT DOCUMENTS

DE 202006013189 10/2006
EP 1579792 9/2005

(Continued)

*Primary Examiner* — Michele L Jacobson
*Assistant Examiner* — Ericson M Lachica
(74) *Attorney, Agent, or Firm* — K&L Gates LLP

(57) ABSTRACT

Capsule (9) for use in a beverage preparation machine (1), said capsule comprising side (10), bottom (12) and top (11) walls defining a closed chamber, said chamber containing an ingredient, said capsule further comprising a beverage dispensing wall able to open for releasing a beverage prepared from said ingredient and said fluid, said capsule further comprising a pierceable plug (14) located adjacent to the inner side of the injection wall of the capsule, and made of a resilient material, said plug having a thickness between 0.5 mm and 10 mm, and said plug having shape and dimensions such as to be pierced through by the fluid injection element (20) when said capsule is functionally inserted within said machine, characterized in that said plug (14) is supported by a plug supporting member (16).

17 Claims, 8 Drawing Sheets

(56) References Cited

U.S. PATENT DOCUMENTS

| | | | | |
|---|---|---|---|---|
| 2012/0070542 | A1* | 3/2012 | Camera et al. | 426/77 |
| 2012/0077012 | A1* | 3/2012 | Liu | B29C 67/202<br>428/221 |

FOREIGN PATENT DOCUMENTS

| | | |
|---|---|---|
| WO | 0056629 | 9/2000 |
| WO | 03073896 | 9/2003 |
| WO | 2008116818 | 10/2008 |

* cited by examiner

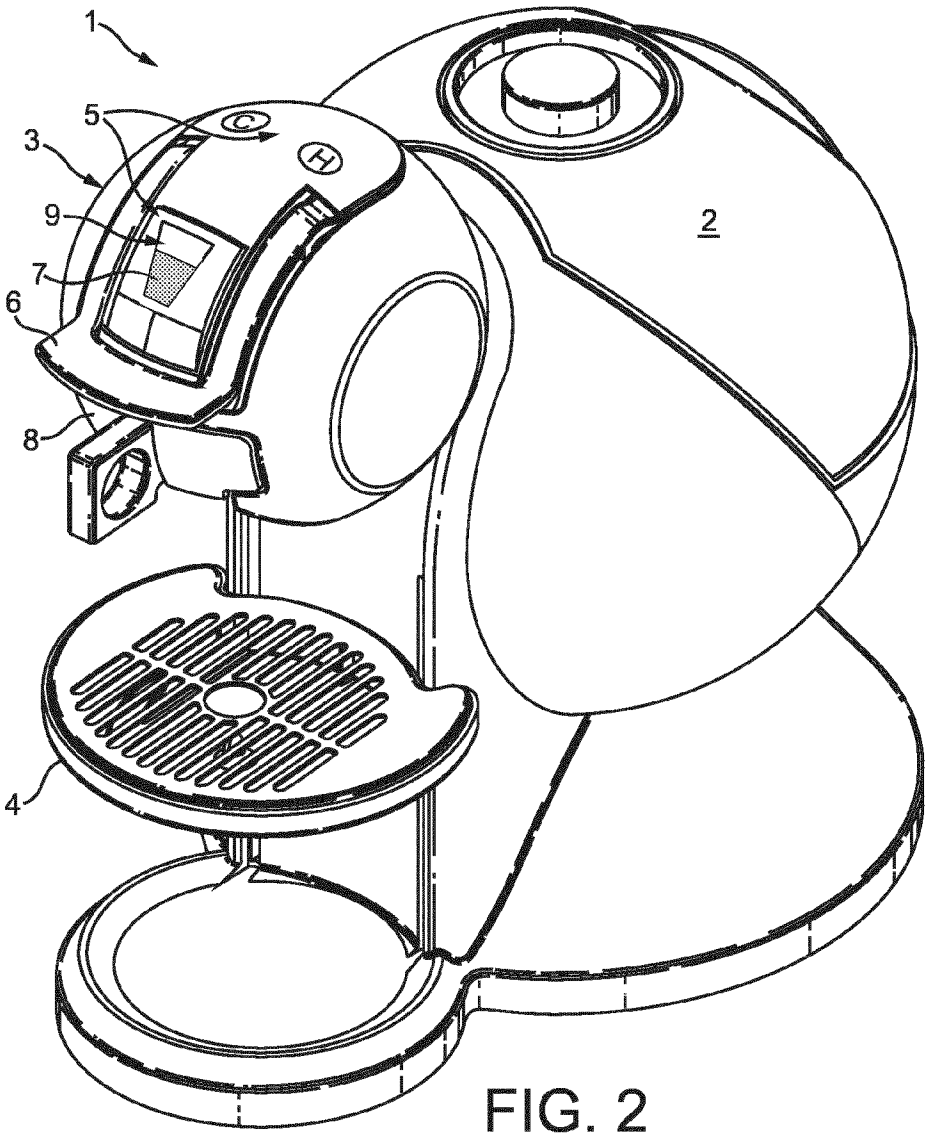
FIG. 2
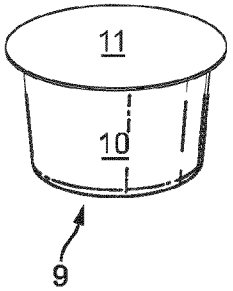

CAPSULE HAVING A PIERCEABLE PLUG TO PREVENT BACKFLOW

CROSS REFERENCE TO RELATED APPLICATIONS

The present application is a National Stage of International Application No. PCT/EP2013/059063, filed on May 1, 2013, which claims priority to European Patent Application No. 12166963.4, filed May 7, 2012, the entire contents of which are being incorporated herein by reference.

FIELD OF THE INVENTION

The present invention concerns a capsule for use in a beverage preparation machine; more precisely it concerns a capsule having a anti-backflow feature.

BACKGROUND OF THE INVENTION

Beverage preparation machines are well known in the food science and consumer goods area. Such machines allow a consumer to prepare at home a given type of beverage, for instance a coffee-based beverage, e.g. an espresso or a brew-like coffee cup.

Today, most beverage preparation machines for in-home beverage preparation comprise a system made of a machine which can accommodate portioned ingredients for the preparation of the beverage. Such portions can be soft pods or pads, or sachets, but more and more systems use semi-rigid or rigid portions such as rigid pods or capsules. In the following, it will be considered that the beverage machine of the invention is a beverage preparation machine working with a rigid or semi-rigid capsule.

The machine comprises a receptacle for accommodating said capsule and a fluid injection system for injecting a fluid, preferably water, under pressure into said capsule. Water injected under pressure in the capsule, for the preparation of a coffee beverage according to the present invention, is preferably hot, that is to say at a temperature above 70° C. However, in some particular instances, it might also be at ambient temperature. The pressure inside the capsule chamber during extraction and/or dissolution of the capsule contents is typically about 1 to about 8 bar for dissolution products and about 2 to about 12 bar for extraction of roast and ground coffee. Such a preparation process differs a lot from the so-called "brewing" process of beverage preparation—particularly for tea and coffee, in that brewing involves a long time of infusion of the ingredient by a fluid (e.g. hot water), whereas the beverage preparation process allows a consumer to prepare a beverage, for instance coffee, within a few seconds.

The principle of extracting and/or dissolving the contents of a closed capsule under pressure is known and consists typically of confining the capsule in a receptacle of a machine, injecting a quantity of pressurized water into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule. Capsules allowing the application of this principle have already been described for example in applicant's European patent no EP 1 472 156 B1, and in EP 1 784 344 B1.

Machines allowing the application of this principle have already been described for example in patents CH 605 293 and EP 242 556. According to these documents, the machine comprises a receptacle for the capsule and a perforation and injection element made in the form of a hollow needle comprising in its distal region one or more liquid injection orifices. The needle has a dual function in that it opens the top portion of the capsule on the one hand, and that it forms the water inlet channel into the capsule on the other hand.

The machine further comprises a fluid tank—in most cases this fluid is water—for storing the fluid that is used to dissolve and/or infuse and/or extract under pressure the ingredient(s) contained in the capsule. The machine comprises a heating element such as a boiler or a heat exchanger, which is able to warm up the water used therein to working temperatures (classically temperatures up to 80-90° C.). Finally, the machine comprises a pump element for circulating the water from the tank to the capsule, optionally though the heating element. The way the water circulates within the machine is e.g. selected via a selecting valve means, such as for instance a peristaltic valve of the type described in applicant's European patent application EP 2162653 A1.

When the beverage to be prepared is coffee, one interesting way to prepare the coffee is to provide the consumer with a capsule containing roast and ground coffee powder, which is to be extracted with hot water injected therein.

Capsules have been developed for such an application, which are described and claimed in applicant's European patent EP 1 784 344 B1, or in European patent application EP 2 062 831.

In short, such capsules comprise typically:

- a hollow body and an injection wall which is impermeable to liquids and to air and which is attached to the body and adapted to be punctured by e.g. an injection needle of the machine,
- a chamber containing a bed of roast and ground coffee to be extracted,
- an aluminum membrane disposed at the bottom end of the capsule, closing the capsule, for retaining the internal pressure in the chamber, the membrane being associated with piercing means for piercing dispensing holes in the aluminum membrane when the internal pressure inside the chamber reaches a certain pre-determined value,
- optionally, means configured to break the jet of fluid so as to reduce the speed of the jet of fluid injected into the capsule and distribute the fluid across the bed of substance at a reduced speed.

Capsules of the prior art feature an injection wall or membrane (referred to as top membrane) which is to be pierced by a fluid injection element (e.g. needle) of a beverage preparation machine being part of a fluid system. When fluid is injected in the capsule compartment, a pressure is built up, which serves as an extraction means for extracting and/or dissolving ingredients contained inside the capsule, as described above. Such ingredients can be for instance a bed of roast and ground coffee "RG" as shown in FIG. 1.

In prior art capsules, when the injection needle is removed from the capsule injection wall, after the beverage has been prepared and dispensed, the capsule top membrane is pierced and a hole remains as illustrated in FIG. 1. However, the internal extraction fluid pressure "P" remains at least partly in the capsule compartment.

The consumer can stop the extraction at any given time and open the machine head, which will create a hole "H" on top membrane while the capsule is still inside the machine. This results in product coming out of top hole (this phenomenon is referred to as "backflow") and causing machine cleanliness issue. Our tests showed that even 0.05 bar is enough to create product back-flow from the top hole on the capsule.

In some exceptional cases, the backflow is very important due to a very high residual internal pressure within the capsule so that a jet of liquid splashes out of the capsule, which is named "whale effect". Such a "whale effect" is represented as an upwardly-directed jet in FIG. 1. Although such a phenomenon occurs randomly and infrequently, it is undesirable because hot liquid splashing out is messy. Moreover, in case the liquid is water mixed with an ingredient, such a leakage of liquid from the capsule top membrane is also undesirable for a cleanliness point of view, which forces the consumer to spend time cleaning the machine and its surroundings after usage.

A solution was developed in current machines to prevent early opening of the machine brewing head, particularly until the capsule internal fluid pressure is sufficiently low. This solution is a five second light blinking on the machine to show consumer not to open the machine head until the blinking stops. However, this solution does not work during extraction of recipes for which more than 5 seconds is necessary to release the pressure inside the capsule after the fluid injection has been stopped inside the capsule.

It is therefore an objective of the present invention to provide a beverage preparation system and capsule that prevents the so-called "backflow" or "whale effect" phenomenon described above, whatever the beverage preparation conditions or ingredient properties.

SUMMARY OF THE INVENTION

The main objective set out above is met with a capsule for use in a beverage preparation machine, said capsule comprising side, bottom and top walls defining a closed chamber, said chamber containing an ingredient to be dissolved and/or extracted by a fluid injected under pressure within said capsule, said fluid being provided through an injection element of the machine that is able to pierce an injection wall of the capsule, said capsule further comprising a beverage dispensing wall able to open for releasing a beverage prepared from said ingredient and said fluid, said capsule further comprising a pierceable plug located adjacent to the inner side of the injection wall of the capsule, and made of a resilient material, said plug having a thickness between 0.5 mm and 10 mm, preferably greater than 1 mm and less than 10 mm, more preferably comprised between 1.5 mm and 5 mm, and said plug having shape and dimensions such as to be pierced through by the fluid injection element when said capsule is functionally inserted within said machine.

According to an essential aspect of the invention, the plug is supported by a plug supporting member.

The supporting member advantageously has the shape of a plate sealed or otherwise assembled mechanically onto the side walls and/or on a top peripheral edge of the capsule, Preferably, the fluid injection wall of the capsule is the top wall, and said beverage dispensing wall is the bottom wall.

The plug supporting member can be made of a flexible, semi-rigid or rigid thermoplastic material. For instance it can be a flexible film sealed onto the capsule walls, or it can be a semi-rigid, or rigid element assembled to the capsule walls as will be described more in detail herebelow, with reference to the drawings.

The plug supporting member preferably has a thickness less than 1 mm, preferably less than 0.5 mm so as to be pierceable by the injection element of the machine.

In a preferred embodiment of the present invention, the plug is made from a foam or rubber-like material chosen within the list of: styrene block copolymers (SBC), thermoplastic polyurethanes (TPU), polyolefin elastomer.

The fluid is injected by the machine with said capsule at a pressure comprised between 0.1 and 20 bar, preferably between 1 and 15 bar, more preferably between 2 and 12 bar.

Advantageously, the fluid injection element of the machine comprises at least one fluid-injection needle.

Furthermore, the beverage dispensing wall preferably comprises:

- opening means to open said wall when fluid pressure inside said chamber increases above a first predetermined level, and
- reclosing means to close the capsule, after said beverage has been dispensed from said chamber and the fluid pressure within said chamber has decreased below a second predetermined level.

The ingredient contained inside the capsule can be roast and ground coffee, and/or is chosen within the list of water-soluble ingredients such as: coffee, tea, cocoa, milk, soup, fruit juice, vegetable juice, soda mix, or infant nutrition products, in powder, gel, compacted powder, or liquid concentrate form, or a combination thereof.

In any case, the side and bottom walls are preferably moisture and oxygen impermeable, and at least one of the top membrane, and/or the assembly made of plug supporting element plus pierceable plug, is/are also moisture and oxygen impermeable.

BRIEF DESCRIPTION OF THE DRAWINGS

Additional features and advantages of the present invention are described in, and will be apparent from, the description of the presently preferred embodiments which are set out below with reference to the drawings in which:

FIG. 2 is a schematic perspective view of a beverage preparation machine suitable for use with a capsule according to the present invention;

DETAILED DESCRIPTION OF THE INVENTION

Figure 1:
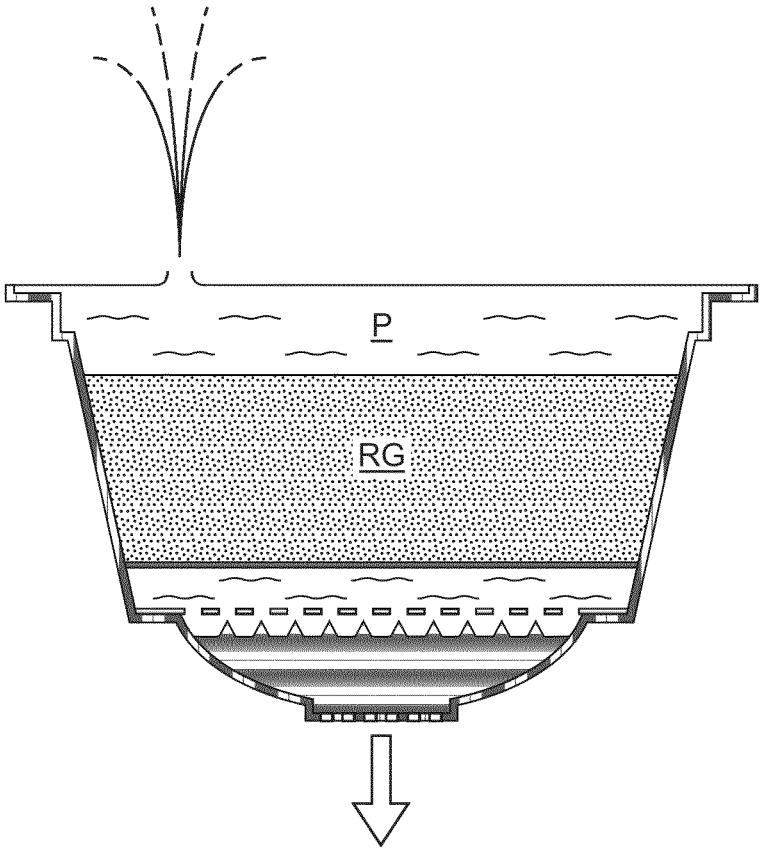
FIG. 1 is a schematic view of a prior art capsule wherein "whale effect" fluid resurgence has occurred.

The capsule according to the present invention is for use in a beverage preparation machine as illustrated in FIG. 2.

Such a beverage preparation machine comprises a base having a reservoir 2, a brewing head 3, a cup tray 4 for holding a cup below the brewing head 3 and wherein the prepared beverage flows. The beverage preparation machine further comprises a control panel 5 for setting working parameters of the machine (e.g. volume of beverage to be dispensed, pressure of the fluid to be injected inside the capsule, temperature of the beverage, etc.).

The beverage preparation machine further comprises a handle 6 for opening and closing the brewing head, respectively in configurations for receiving a capsule and for preparing a beverage (closed brewing head in functional configuration). It also comprises a display 7 for displaying information to the user about the machine settings, progression of the beverage preparation, etc. Also, the machine 1 comprises a capsule holder 8 for holding a capsule 9. Said capsule holder is adapted to be removably introduced in a specific recess of the brewing head 3. In FIG. 2, the capsule holder is shown in place within the brewing head.

A capsule 9 for use in the beverage preparation machine 1 is also illustrated in FIG. 2. It comprises a body with side walls 10, and a top membrane 11. The capsule side walls 10 are rigid or semi-rigid thermoplastic material, and the top membrane 11 is made of a monolayer or multilayer thermoplastic material that is sufficiently thin to be pierceable by a fluid injection needle located in the brewing head of the machine 1.

A capsule according to the invention is represented in detail in FIGS. 3 and 4. The capsule bottom wall 12 and side walls 10 are made as one integral part. The bottom wall comprises a bottom dispensing opening and the top portion of the capsule bottom is covered by a pierceable membrane that seals the inner portion of the capsule ingredient chamber from the outside. Finally, the bottom portion of the capsule comprises piercing elements which are able to pierce the bottom pierceable membrane when fluid pressure builds up within the capsule, along the principle described in Applicant's earlier patent publication EP 1 472 156 B1, incorporated herein by reference. The capsule further comprises a top membrane 11, which is to be sealed on a top peripheral edge 13 of the capsule side walls 10.

Figure 3A:
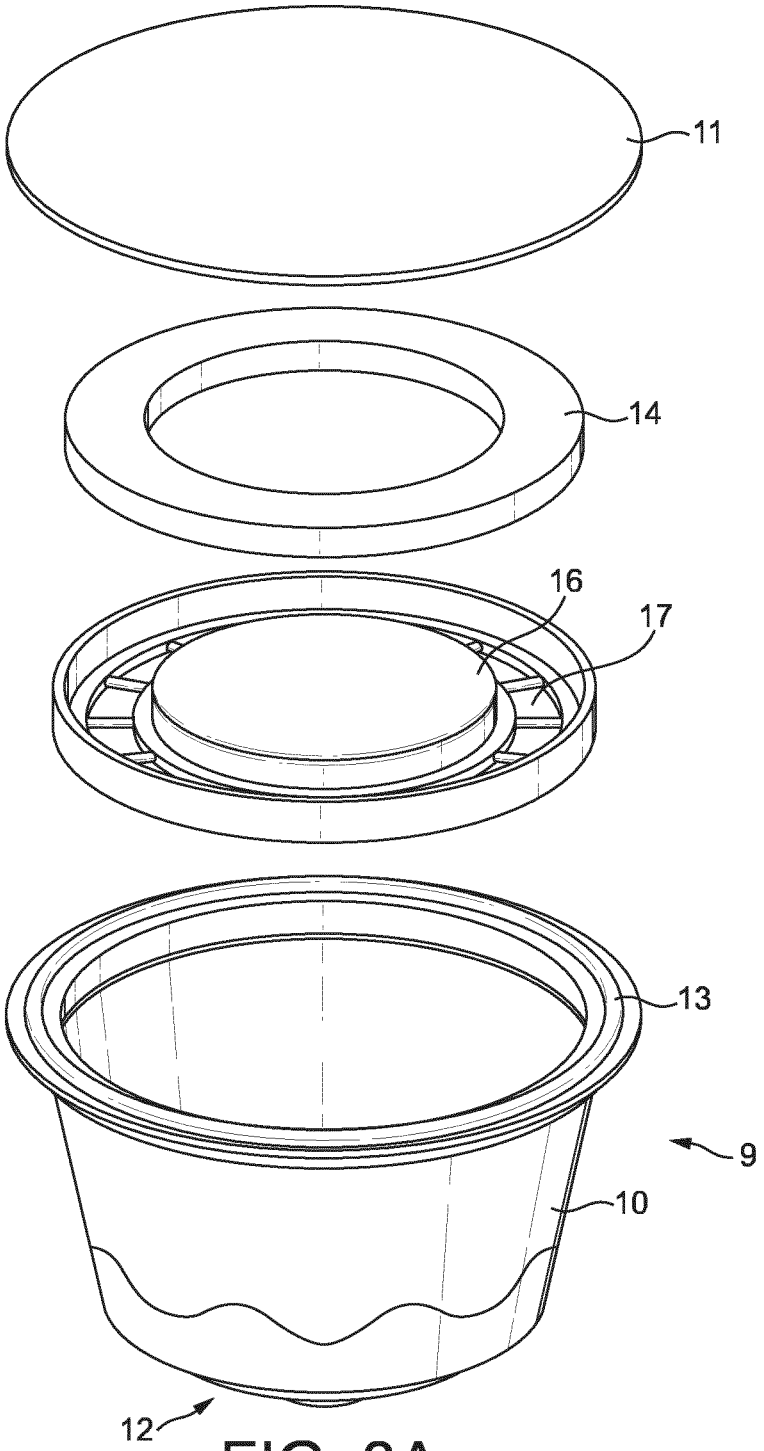
FIG. 3A is a spilt perspective view of a first embodiment of the capsule according to the invention.
Figure 3B:
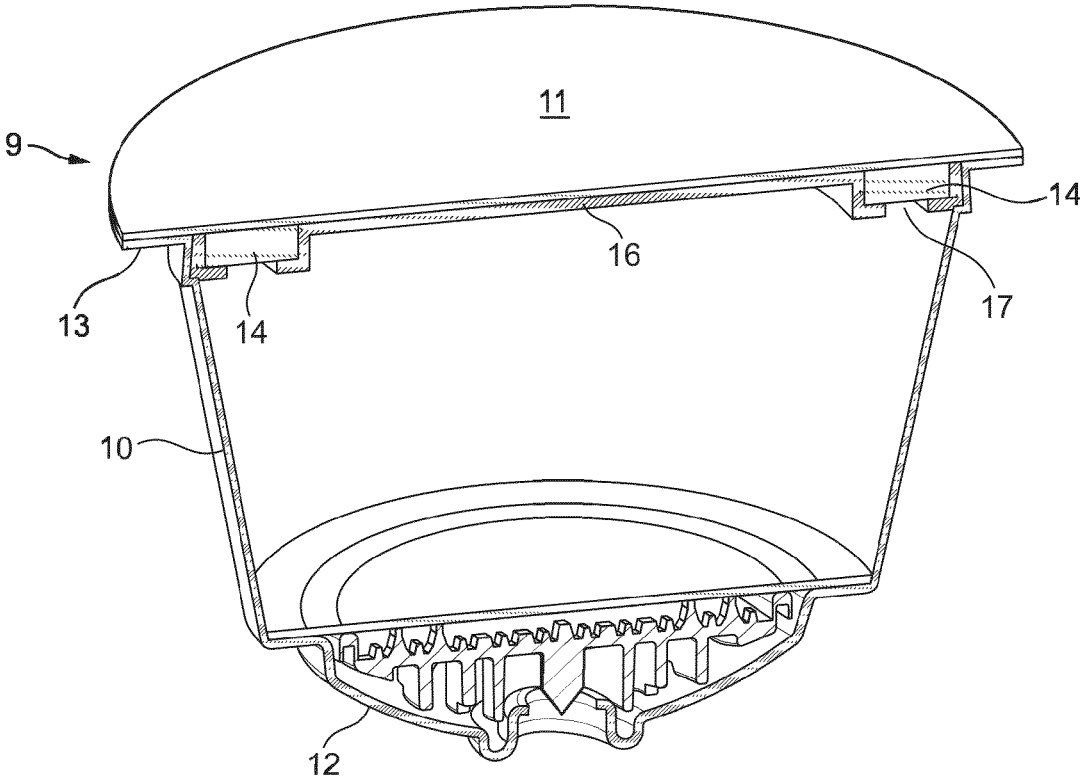
FIG. 3B is cut perspective view of a capsule similar to that of FIG. 3A.
Figure 3C:
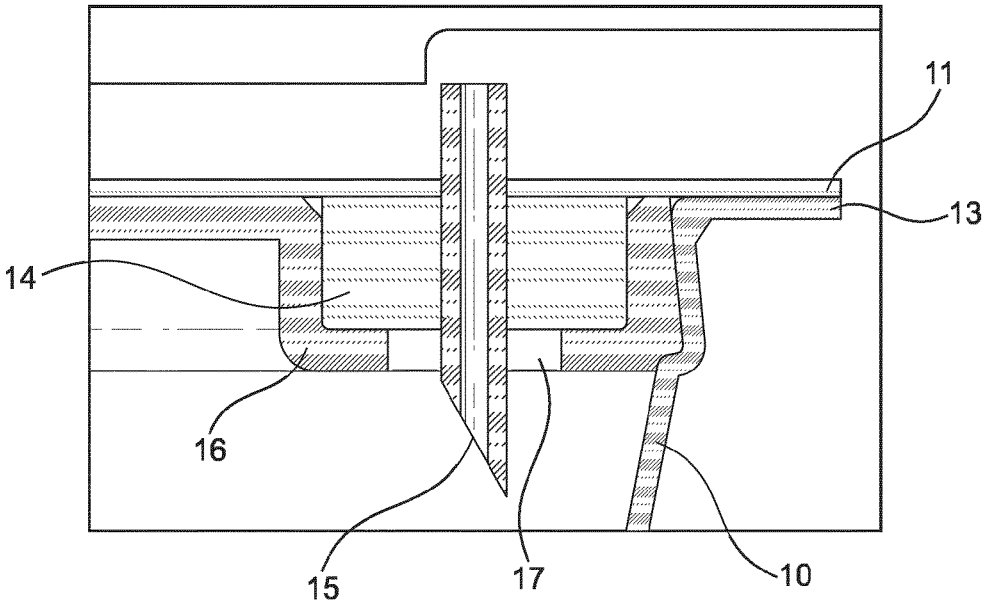
FIG. 3C is an enlarged cut profile view of a capsule similar to that of FIG. 3B, wherein the fluid injection needle pierces through the injection wall and plug element of the capsule.

According to a first embodiment of the invention illustrated in FIGS. 3A, 3B and 3C, the capsule further comprises a pierceable plug 14 located adjacent to the inner side of the injection top wall 11 of the capsule, and made of a resilient material.

The plug 14 has a thickness of about 2 mm, and its shape and dimensions are such that said plug is pierced through by the fluid injection needle 15 of the machine, when said capsule is functionally inserted within said machine, as illustrated in FIG. 3C. More precisely, the plug has the shape of a crown as illustrated in FIG. 3A.

Also according to the invention, the plug 14 is supported by a plug supporting member 16.

As shown in FIG. 3A, the supporting member 16 advantageously has the shape of a plate sealed or otherwise assembled mechanically onto the side walls and/or on the top peripheral edge 13 of the capsule 9. More precisely, the plug supporting plate 16 has a disc shape that fits to the cup-shape chamber of the capsule. The supporting plate 16 is cut-out with openings 17 in the region where the fluid injection needle will pierce, when the capsule is functionally inserted within the machine.

In this first embodiment of the invention, the plug 14 is located in between the top injection wall 11 of the capsule, and the plug supporting member 16, as can be seen in FIGS. 3A and 3B. The plug is adjacent, and more than that, it is in contact with the inner surface of the top membrane 11.

Figure 4A:
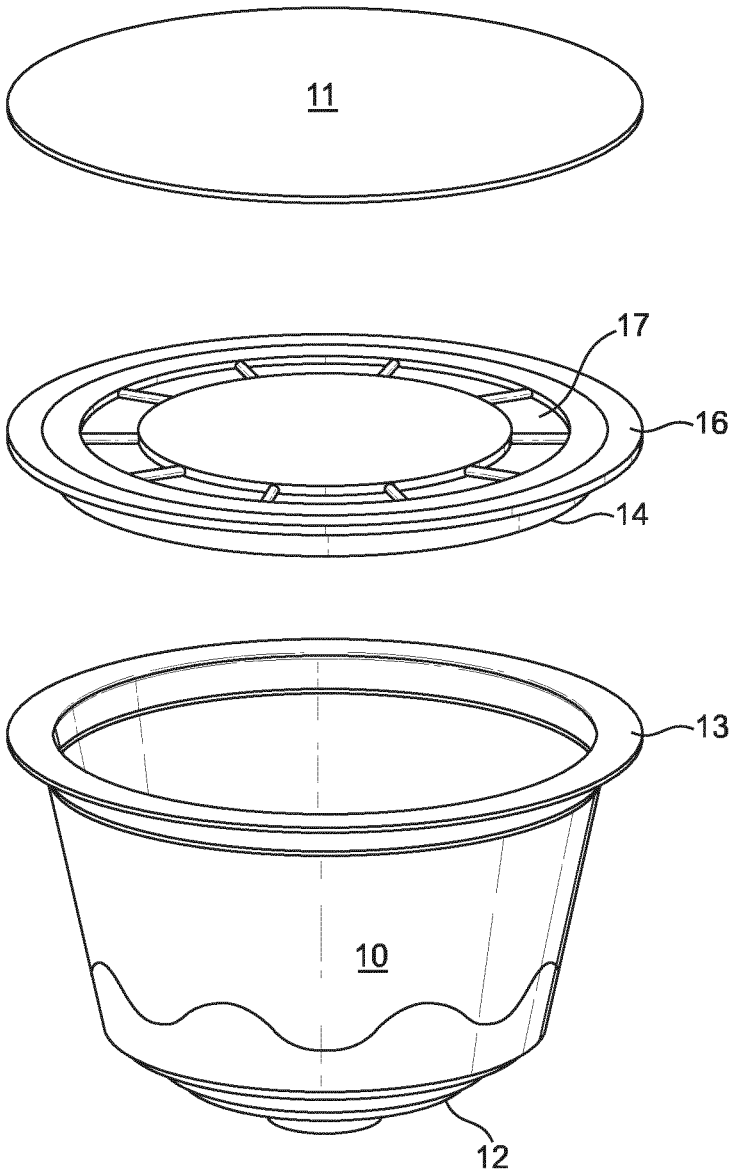
FIG. 4A is a spilt perspective view of a second embodiment of the capsule according to the invention.
Figure 4B:
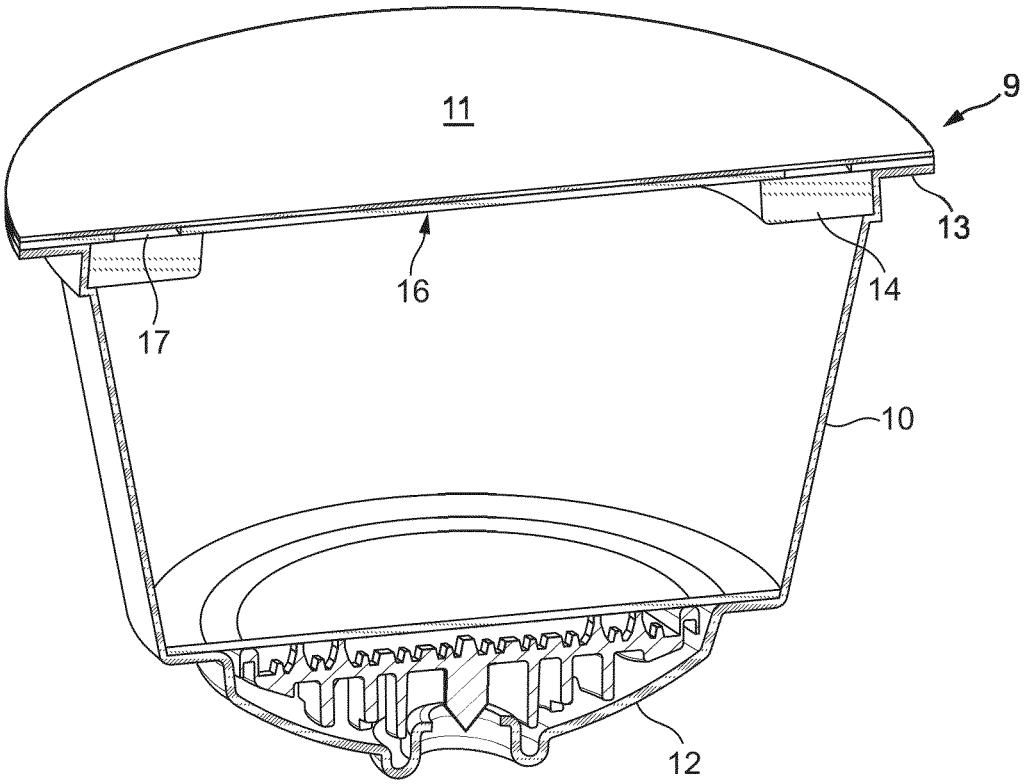
FIG. 4B is cut perspective view of a capsule similar to that of FIG. 4A.

In a second embodiment of the invention illustrated in FIGS. 4A and 4B, the capsule can have a similar structure to that described above in reference to FIG. 3A to 3C. But in this embodiment, the plug supporting element 16 is located above the plug 14, that is to say, between the top membrane 11 of the capsule and the plug 14 itself. In that embodiment, the plug 14 is adjacent, but not in direct contact with the inner surface of the top membrane 11.

In both the first and second embodiments of the invention described above, the top membrane 11 is moisture and oxygen barrier, as well as the side 10 and bottom 12 walls of the capsule 9, such that all capsule walls define a closed chamber for containing an ingredient, which is moisture and oxygen barrier, and therefore provides extended shelf life for the ingredient contained therein.

In an alternative third embodiment of the invention, that is very similar to the third embodiment, the barrier to gas and moisture is achieved by the material of the plug 14 and supporting element 16, not by the top membrane 11.

Figure 5A:
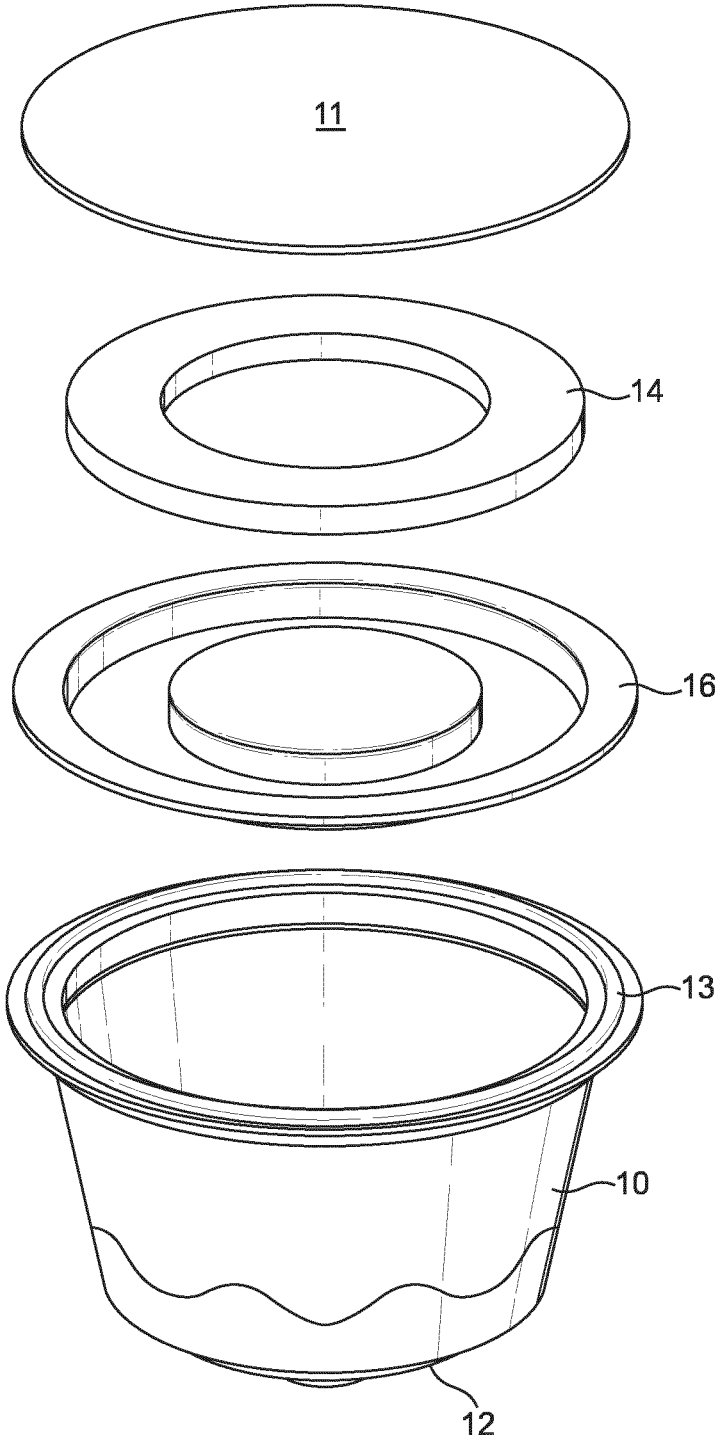
FIG. 5A is a spilt perspective view of a third embodiment of the capsule according to the invention.
Figure 5B:
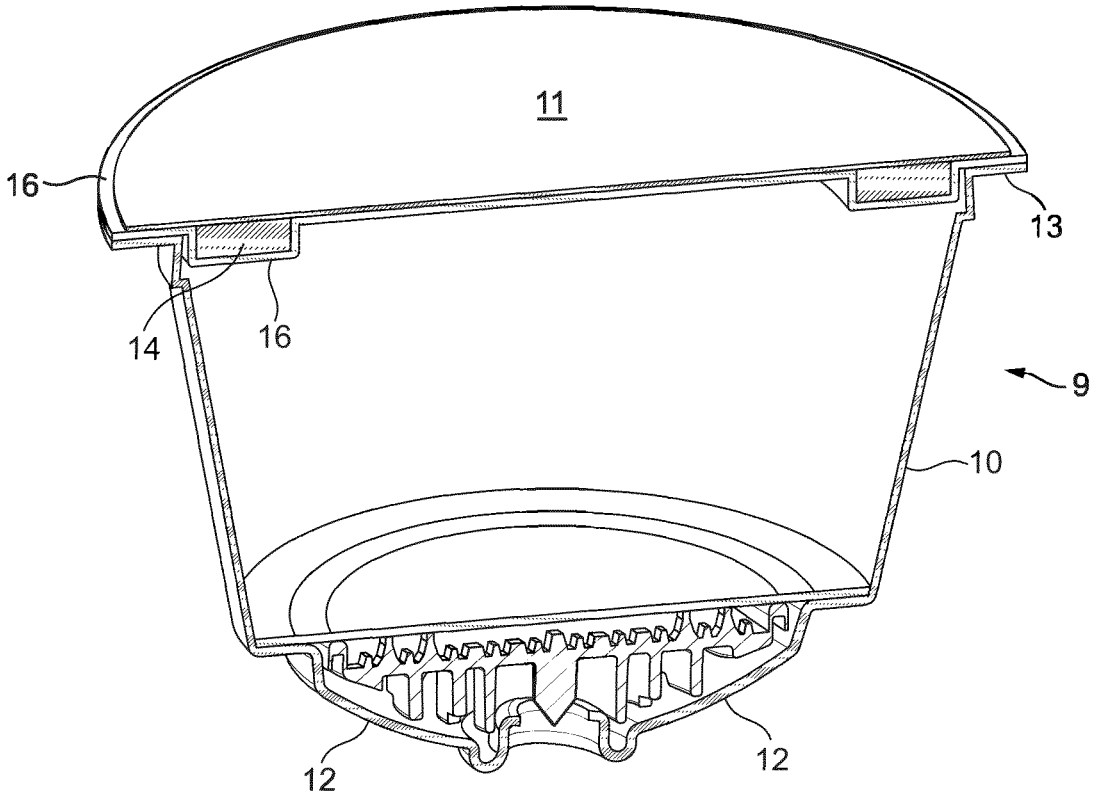
FIG. 5B is cut perspective view of a capsule similar to that of FIG. 5A.

In a fourth embodiment of the invention represented in FIGS. 5A and 5B, the capsule is very similar to the invention described above in reference to FIGS. 3A to 3C. In this fourth embodiment of the invention, the supporting plate is plain, as illustrated in FIG. 5A. In this case, due to the fact that the plug supporting plate 16 does not comprise cut-out openings to accommodate the fluid injection needle of the machine, the material and thickness of the plate 16 must be such that the latter can be pierced by the needle when the capsule is inserted within the beverage preparation machine in its functional configuration. More precisely the material for the plate 16 is preferably a soft plastic, and its thickness is not greater than 1 mm, preferably not greater than 0.5 mm, at least in the region where it should be pierced through by the injection needle.

In all embodiments of the present invention, the plug 14 can be attached to the plug supporting member 16 by different means, such as for instance heat sealing, clipping, gluing, ultrasonic sealing, or alternatively, the plug 14 can be co-injected together with the plug supporting member 16.

The material for making the plug 14 is sufficiently resilient to ensure that the hole pierced through the thickness of said plug by the fluid injection needle of the machine self-closes, at least partially after the needle is removed therefrom. Such a reclosability effect ensures that none, or very little, of the liquid contained in the capsule will flow back through the thickness of the plug when the needle is removed from the capsule. Preferably, the material for making the plug self-closes back completely to ensure a leaktightness even if the liquid contained in the capsule is under pressure (ranges of fluid injection pressure were already mentioned above). Suitable materials for manufacturing the plug in a capsule according to the present invention include, but are not limited to: elastomeric material compatible with food packing use like, silicone, styrene block copolymers (SBC), thermoplastic polyurethanes (TPU), polyolefin elastomer, etc. The plug is in the form of a rubber, or a foam-like material element. The plug can be injected, co-injected, or deposited onto the surface of the supporting element as a liquid melted form which then solidifies.

The diameter of the needle is preferably comprised between 0.5 mm and 3 mm, and more precisely between 1.0 mm and 1.6 mm. For instance the needle can have 1.5 mm in diameter with a 30° apex cut angle. The needle used for the liquid injection in the capsule is preferably stainless steel. Preferentially, if the hole self-closes enough to be air tight, additionally it also ensures "pipette" effect and prevents dripping from the bottom of capsule.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for use in a beverage preparation machine, the capsule comprising:

side, bottom and top walls defining a closed chamber, the chamber containing an ingredient to be dissolved and/or extracted by a fluid injected under pressure within the capsule, the fluid being provided through an injection element of the beverage preparation machine that is able to pierce an injection wall of the capsule;

a beverage dispensing wall able to open for releasing a beverage prepared from the ingredient and the fluid; and a pierceable plug located adjacent to an inner side of the injection wall of the capsule and made of a resilient material, the pierceable plug having a thickness between 0.5 mm and 10 mm, and the pierceable plug having a shape and dimensions such as to be pierced through by the injection element when the capsule is functionally inserted within the beverage preparation machine, the pierceable plug is supported by a plug supporting member, the pierceable plug has a ring shape concentric to the top wall, and the plug supporting member has a plurality of openings arranged in a circular configuration that is vertically aligned with the pierceable plug.

2. The capsule of claim 1, wherein the injection wall is the top wall, and the beverage dispensing wall is the bottom wall.

3. The capsule of claim 1, wherein the plug supporting member is made of a material selected from the group consisting of a flexible material, a semi-rigid material and a rigid thermoplastic material.

4. The capsule of claim 3, wherein the plug supporting member has a thickness of less than 1 mm and is pierceable by the injection element of the beverage preparation machine.

5. The capsule of claim 1, wherein the pierceable plug is made from a foam or rubber-like material selected from the group consisting of styrene block copolymers (SBC), thermoplastic polyurethanes (TPU), and polyolefin elastomer.

6. The capsule of claim 1, wherein the beverage dispensing wall comprises:

an opening member to open the injection wall when fluid pressure inside the chamber increases above a first predetermined level; and a reclosing member to close the capsule, after the beverage has been dispensed from the chamber and the fluid pressure within the chamber has decreased below a second predetermined level.

7. The capsule of claim 1, wherein the ingredient is selected from the group consisting of roast and ground coffee and water-soluble ingredients and has a form selected from the group consisting of a powder form, a gel form, a compacted powder form, a liquid concentrate form, and combinations thereof.

8. The capsule of claim 1, wherein the side and bottom walls are moisture and oxygen impermeable, the plug supporting member and the pierceable plug form an assembly, and at least one of (i) the top wall and/or (ii) the assembly is/are also moisture and oxygen impermeable.

9. The capsule of claim 2, wherein the plug supporting member comprises a plate attached to a component selected from the group consisting of the side walls, a top peripheral edge of the capsule, and a combination thereof.

10. The capsule of claim 9, wherein the plate has a disc shape that fits to the chamber of the capsule.

11. The capsule of claim 9, wherein the plate comprises the plurality of openings configured to receive the injection element piercing the injection wall.

12. The capsule of claim 2, wherein the top wall is positioned above the pierceable plug, and the pierceable plug is positioned between the top wall of the capsule and the plug supporting member.

13. The capsule of claim 12, wherein the pierceable plug abuts an inner surface of the injection wall.

14. The capsule of claim 2, wherein the plug supporting member is positioned above the pierceable plug, between the top wall of the capsule and the pierceable plug.

15. The capsule of claim 14, wherein the pierceable plug is not in direct contact with the top wall.

16. The capsule of claim 2, wherein the pierceable plug self-closes at least partially after the injection element is removed therefrom.

17. The capsule of claim 2, wherein the pierceable plug self-closes completely after the injection element is removed therefrom.

* * * * *